US007210202B2

(12) United States Patent
Hamada

(10) Patent No.: US 7,210,202 B2
(45) Date of Patent: May 1, 2007

(54) REVERSE-SEPARATING DEVICE FOR SLIDE FASTENER

(75) Inventor: Yoshikazu Hamada, Uozu (JP)

(73) Assignee: YKK Corporation, Tokyo (JP)

( * ) Notice: Subject to any disclaimer, the term of this patent is extended or adjusted under 35 U.S.C. 154(b) by 54 days.

(21) Appl. No.: 11/064,205

(22) Filed: Feb. 23, 2005

(65) Prior Publication Data

US 2005/0193528 A1 Sep. 8, 2005

(30) Foreign Application Priority Data

Mar. 5, 2004 (JP) ..... 2004-062800

(51) Int. Cl.
*A44B 19/38* (2006.01)

(52) U.S. Cl. ..... 24/433; 24/436

(58) Field of Classification Search ..... 24/386, 24/433–436

See application file for complete search history.

(56) References Cited

U.S. PATENT DOCUMENTS 2,026,671 A * 1/1936 Butterfield ..... 24/406
2,553,230 A 5/1951 Bashover
3,872,551 A * 3/1975 Moertel ..... 24/388
4,232,432 A * 11/1980 Akashi ..... 24/394
4,312,103 A * 1/1982 Akashi ..... 24/386
2002/0050031 A1* 5/2002 Takasawa et al. ..... 24/433

FOREIGN PATENT DOCUMENTS

EP 1074196 A1 * 2/2001
GB 624334 7/1947

* cited by examiner

*Primary Examiner*—James R. Brittain
(74) *Attorney, Agent, or Firm*—Everest Intellectual Property Law Group; Michael S. Leonard

(57) ABSTRACT

A reverse-separating device for a slide fastener, comprises a retainer pin 5, a separable pin 6 both made of metal and a reverse-separating slider 3. Each of the retainer pin 5 and the separable pin 6 is of a U-shaped cross-section and has a slit 18 formed along its front edge. At the lower end of the slit 18, the retainer pin 5 projects rearward beyond the slit 18 to thus provide a loop-like stopper 22 for engagement with the flange 31 of the reverse-separating slider 3. Once the retainer pin 5 is inserted into the reverse-separating slider 3, the retainer pin 5 is firmly retained by three parts of the reverse-separating slider 3. The separable pin 6 has a projecting ledge 28 formed on the upper end the projecting fin 27 so as to project laterally therefrom. The projecting ledge 28 of the separable pin 6 is adapted to abut against the upper end of the projecting fin 25 of the retainer pin 5 and thus prevent the separable pin 6 from moving further into the reverse-separating slider 3.

6 Claims, 10 Drawing Sheets

REVERSE-SEPARATING DEVICE FOR SLIDE FASTENER

CROSS-REFERENCE TO RELATED APPLICATIONS

The entire disclosures of Japanese patent application number 2004-062800 filed on Mar. 5, 2004 is incorporated herein by reference in its entirety.

BACKGROUND OF THE INVENTION

1. Field of the Invention

This invention relates to a reverse-separating device for a slide fastener used on a clothes having an opening formed in its front, such as a jumper, overcoat; and particularly to a reverse-separating device made of metal attached to the ends of a slide fastener for opening and closing a pair of right and left fastener stringers of the slide fastener.

2. Description of the Related Art

Heretofore, there has been known an ordinary separating device which is comprised of a separable pin attached to the bottom end of one of the two stringers and a retainer attached to the bottom end of the other stringer. The retainer is comprised of a retainer box and a retainer pin which extends upward from the retainer box and is of a U-shaped cross-section. The retainer box and the retainer pin either can be made as one unit at one time by a die-casting process. Alternatively, they can be separately made and thereafter be assembled by clamping the retainer pin within the retainer box. In either method, the retainer pin is clamped onto the bottom end of one fastener tape. In order to close the slide fastener, the separable pin attached to one stringer is inserted into the retainer box attached to the other stringer, and thereafter, the slider moves upward to close the slide fastener.

A reverse-separating device for a slide fastener is shown in the specification of UK Patent Application Publication No. 624334. A retainer pin 100 of this reverse-separating device is reproduced in FIG. 12 of the drawings attached hereto for convenience's sake. The retainer pin 100 is stamped of a metal plate into a U-shaped cross-section and has a pair of opposed flanges 102 formed longitudinally on its one side. A flat stop 104 is provided on the bottom end of the retainer pin so as to project laterally therefrom. The stop 104 is intended to stop descent of a reverse-separating slider.

The ordinary separating device which is comprised of the retain box, the retain pin and the separable pin described first above cannot be used as a reverse-separating device.

On the other hand, the retainer pin 100 of the reverse-separating device reproduced in FIG. 12 has the flat stop 104 formed integral therewith. However, the retainer pin 100 has a problem. It is stamped from a metal plate, but, since the stamping operation is complex, it is impossible to form the retainer pin 100 at a single step. Furthermore, the retainer pin 100 is not of a shape suitable to be subjected to feeding process with an automatic parts feeding machine for attaching the retainer pin 100 to the edge of the fastener tape. It is therefore tedious to attach the retainer pin 100 to the fastener tape.

In view of the problems mentioned above, it is an object of this invention to provide a metal-dicast reverse-separating device for a slide fastener wherein a retainer pin and a separable pin are simple in construction and so each can be produced in a single step, and furthermore, the retainer pin and the separable pin can be efficiently subjected to feeding operation with an automatic parts feeding machine.

It is another object of this invention to provide a metal-dicast reverse-separating device wherein the retainer pin can be clamped to the bottom end of the fastener tape through its plastic deformation reliably, easily and sightly.

It is still another object of this invention to provide a metal-dicast reverse-separating device, wherein the retainer pin is attached to the fastener stringer with the stopper spaced from the lower edge of the fastener tape and the impact that the stopper suffers when the stopper stops the reverse-separating slider will not influence the end of the fastener tape, so that the retainer pin is durable.

It is yet another object of this invention to provide a metal-dicast reverse-separating device which is improved in strength to endure stresses tending to thrust up perpendicularly of the fastener chain, wherein the stopper sets up the limit up to which the separable pin can be inserted into the reverse-separating slider, to thus determine accurate relative position between the retainer pin and the separable pin.

It still another object of this invention to provide a metal-dicast reverse-separating device wherein the retainer pin can maintain its predetermined posture and the retainer pin and the reverse-separating slider can keep engaged with each other reliably.

SUMMARY

In accordance with this invention, a reverse-separating device for a slide fastener is comprised of a pair of fastener stringers including a pair of fastener tapes and two rows of fastener elements mounted along the respective opposed longitudinal edges thereof The reverse-separating device comprises a retainer pin made of metal and attached to the lower end of one fastener stringer, a separable pin made of metal and attached to the other stringer and a reverse-separating slider mounted reciprocally on the rows of the fastener elements and having a pair of flange formed on its respective opposed sides. Each of the retainer pin and the separable pin comprises a pair of upper and lower walls, a side wall connecting the upper and lower walls along the front edge thereof and a slit formed longitudinally along the rear edge to thus provide a U-shaped cross-section. At the lower end of the slit, the upper wall and the lower wall of the retainer pin project rearward beyond the slit and are connected by a bridge portion to thus provide a loop-like stopper with a cavity formed therein The loop-like stopper is adapted to abut against the flange of the reverse-separating slider and to stop the downward movement thereof.

DRAWINGS-FIGURES

DRAWINGS-REFERENCE NUMERALS

Figure 1:
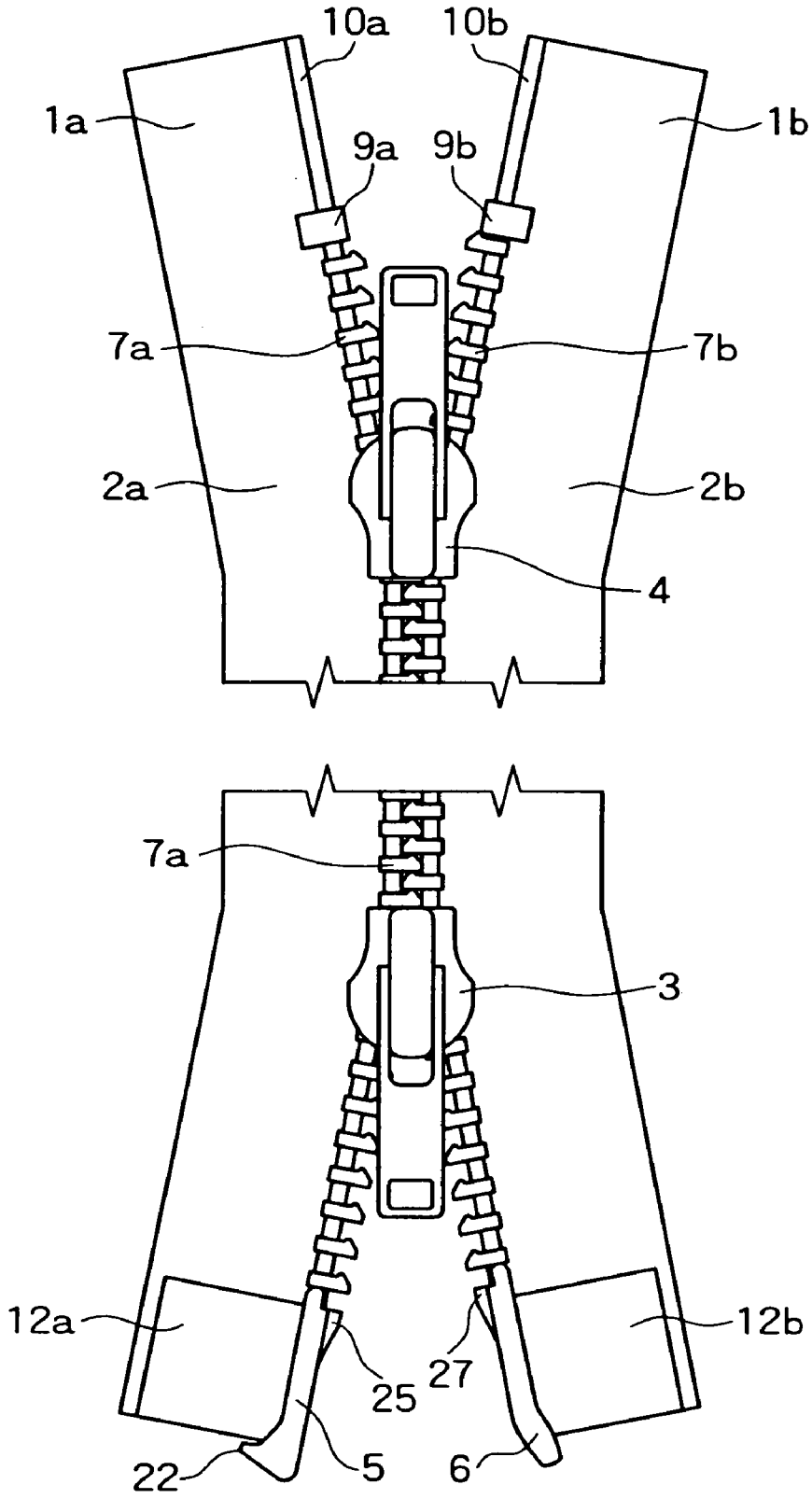
FIG. 1 is a front view of a slide fastener incorporating a reverse-separating device according to the present invention.

1*a*,1*b* Fastener stringer
3 Reverse-separating slider
2*a*,2*b* Stringer tape, fastener tape
4 Upward-separating slider
5 Retainer pin
6 Separable pin
8 Film
9 Top stop
11 End
7*a*,7*b* Fastener elements
15 Upper wall (of Retainer pin)
16 Lower wall (of Retainer pin)
17 Side wall (of Retainer pin)
18 Opening, slit (of Retainer pin)
19 Rear edge (of Retainer pin)
10*a*,10*b* Core portion
20 Front edge (of Retainer pin)
21 Locking rib (of Retainer pin)
22 Stopper (of Retainer pin)
23 Cavity (of Retainer pin)
12*a*,12*b* Reinforced portion
24 Recess (of Retainer pin)
25 Projecting fin (of Retainer pin)
27 Projecting fin (of Separable pin)
28 Projecting ledge (of Separable pin)
30 Guidepost
31 Flange
32 Inner surface of the flange
33 Wing
34 Element-passing channel
40 Front edge (of Separable pin)
41 Locking rib (of Separable pin)
45 Upper wall (of Separable pin)
46 Lower wall (of Separable pin)
47 Side wall (of Separable pin)
48 Opening, slit (of Separable pin)
49 Rear edge (of Separable pin)

DETAILED DESCRIPTION

Description will be now made below about the reverse-separating device according to the embodiment shown in FIGS. 1 through 11. As shown in FIG. 1, a reverse-separating device according to the present invention is used on a slide fastener. The slide fastener is comprised of a pair of right and left fastener stringers 1*a*, 1*b* comprising a pair of fastener tapes 2*a*, 2*b* having bulged core portions 10*a*, 10*b* formed along the respective front or opposed edges thereof and two rows of fastener elements 7*a*, 7*b* mounted on the bulged core portions 10*a*, 10*b*. The fastener elements 7*a*, 7*b* are made of metal such as zinc alloy or aluminum alloy. An upward-separating slider 4 is reciprocally mounted on opposed rows of the fastener elements 7*a*, 7*b* in order to open and close the right and left fastener stringers 1*a*, 1*b*. A pair of upper end stops 9 are mounted on the upper ends of the respective opposed fastener stringers 1*a*, 1*b*. A reverse-separating slider 3 is reciprocally mounted on the fastener elements 7*a*, 7*b* below the upward-separating slider 4 and disposed reversely in posture in respect of the upward-separating slider 4. One stringer 1*a* has a retainer pin 5 attached to the lower end thereof, and the other stringer 1*b* has a separable pin 6 attached to the lower end thereof in opposed relation to the retainer pin 5. The reverse-separating device according to the present invention is comprised of the reverse-separating slider 3, the retainer pin 5 and the separable pin 6. The retainer pin 5 and the separable pin 6 of the reverse-separating device are both made of zinc alloy or aluminum alloy through die-casting process.

As shown in FIGS. 2 through 5, the retainer pin 5 is comprised of an upper wall 15, a lower wall 16, a side wall 17 joining the upper and lower wall 15, 16 at their respective front edges and a slit or opening 18 formed in the side opposed to the side wall 17, to thus provide a substantially U-shaped cross-section. The front edge 20 of the retainer pin 5 or the outer surface of the side wall 17 is substantially rectilinear. The upper and lower walls 15, 16 of the retainer pin 5 have a pair of locking ribs 21 formed longitudinally on the rear edge 19 thereof or the side opposed to the side wall 17 in parallel to the front edge 20 so as to project towards each other or into the slit 18. At the lower end of the slit 18, the upper wall 15 and the lower wall 16 project rearward beyond the slit 18 and are connected by a bridge portion 26 to thus provide a loop-like stopper 22 with a cavity 23 formed therein. Since the upper and lower wall 15, 16 are connected by the bridge portion 26 at the distal end of the stopper 22, the stopper 22 itself has been made stout.

The presence of the loop-like stopper 22 at the bottom end of retainer pin 5 permits the upper and lower walls 15, 16 to plastically deform uniformly over the entire length of the retainer pin 5, thus facilitating clamping the retainer pin 5 to the fastener tape 2*a*. In addition, the loop-like stopper 22 has the following additional advantage. If the stopper 22 were left U-shaped as the rest of the retainer pin 5, instead of being looped; retainer pins would be likely to be tangled with each other when they are ground by a barrel grinding machine or they are fed by an automatic feeding machine, etc. Once they are tangled, it is difficult and tedious to untangle the tangled retainer pins. Since the stopper 22 is of loop-like shape, the retainer pins will never be tangled, so that they can undergo smooth grinding and feeding operation.

Figure 2:
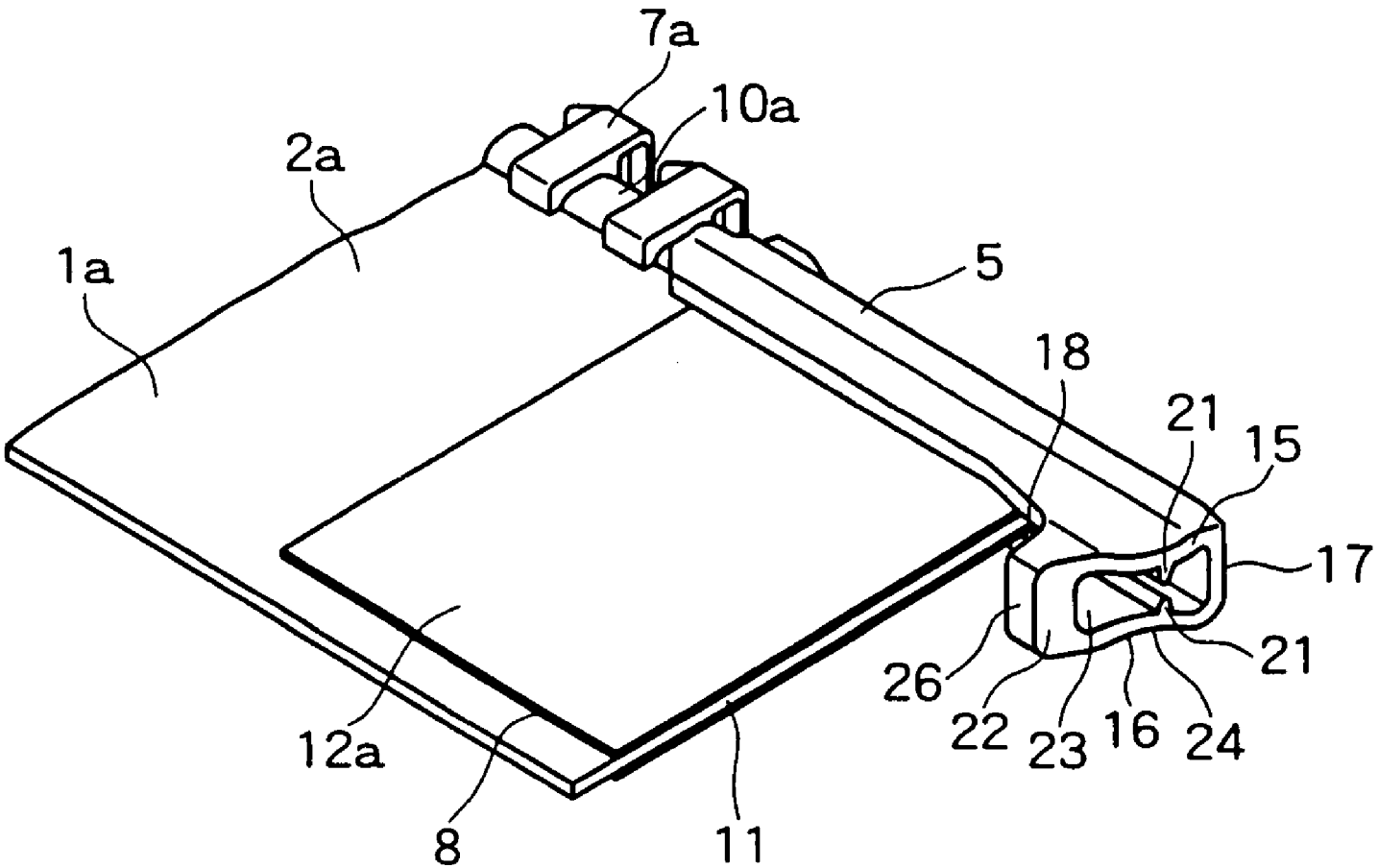
FIG. 2 is a perspective view showing a retainer pin (of the reverse-separating device) attached to one fastener stringer of the slide fastener of FIG. 1.
Figure 3:
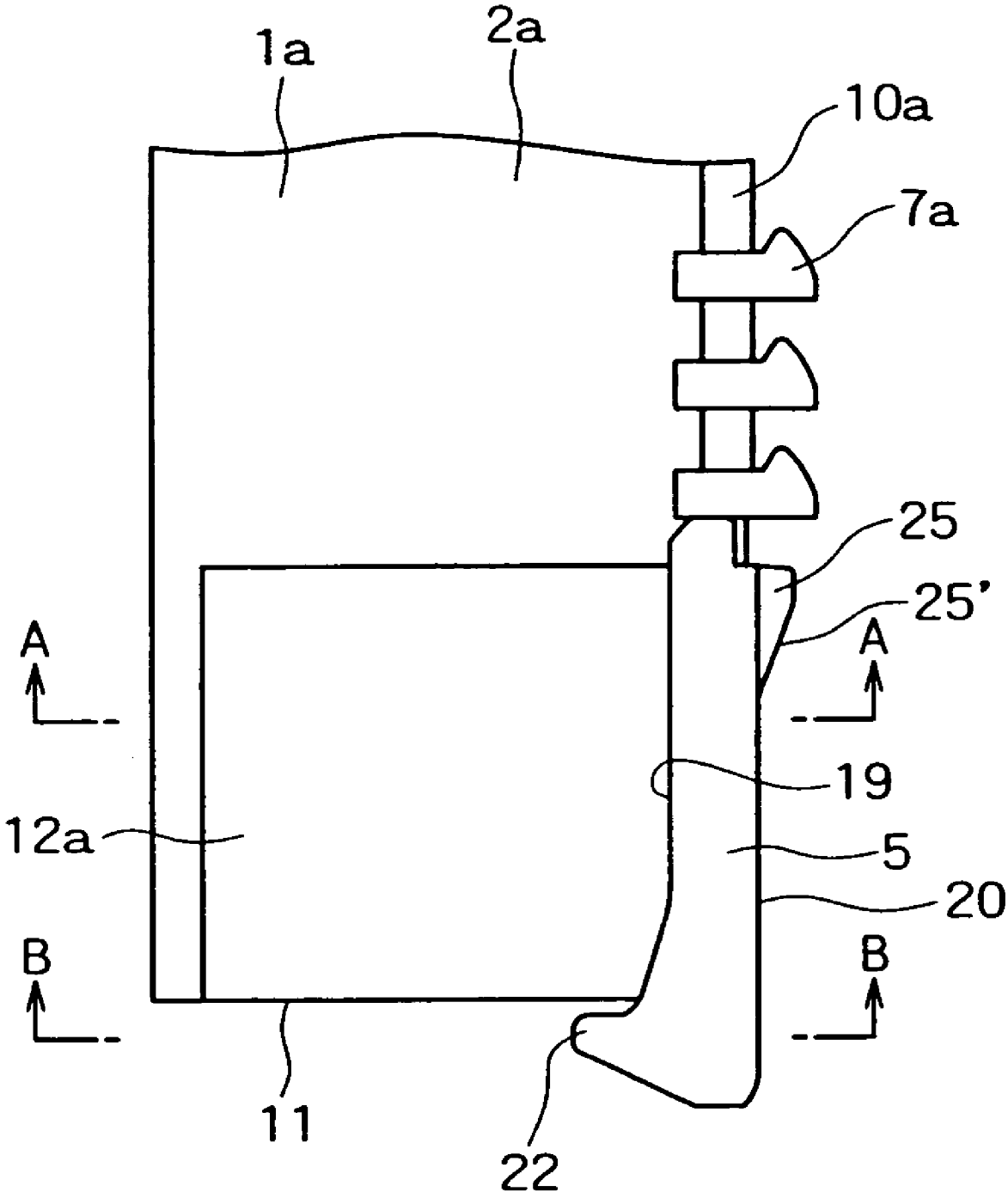
FIG. 3 is a front view of the retainer pin (of the reverse-separating device) attached to said one stringer.
Figure 4:
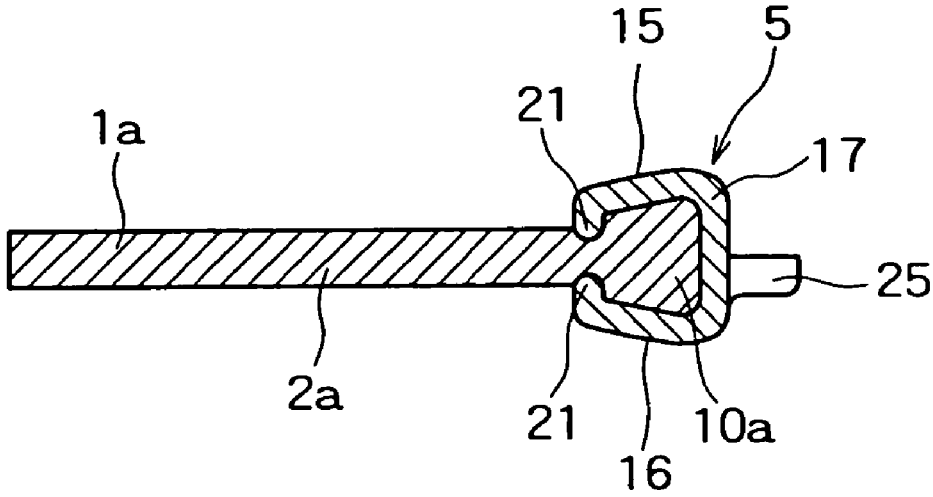
FIG. 4 is a cross-sectional view taken on line A—A of FIG. 3.
Figure 5:
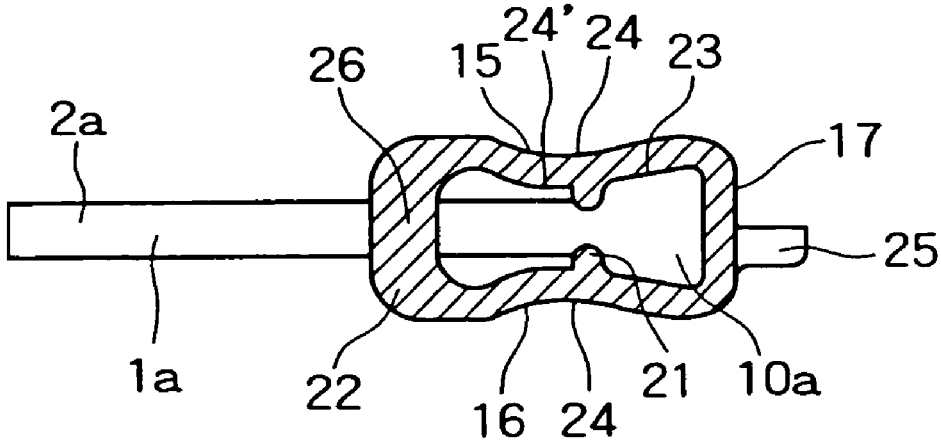
FIG. 5 is a cross-sectional view taken on line B—B of FIG. 3.

As better shown in FIG. 2, the retainer pin 5 is clamped on a reinforced portion 12*a* contiguously to the lower end of a row of the fastener elements 7*a* of one or the left fastener stringer 1*a*. In order to form the reinforced portion 12*a*, 12*b* at the lower end of each fastener tape 2*a*, 2*b*, some fastener elements have first been removed from the lower end of the fastener stringers 1*a*, 1*b*. Then, plastic films 8 are applied to both front and rear surfaces of the lower ends of the fastener tapes 2*a*, 2*b*, to thus form reinforced portions 12*a*, 12*b* on the respective ends of the fastener tapes 2*a*, 2*b*. In order to attach the retainer pin 5 to the reinforced portion 12*a;* first, the reinforced portion 12*a* of the fastener tape 2*a* is inserted into the slit 18 of the retainer pin 5 with the stopper 22 slightly projecting beyond the bottom edge 11 of the fastener tape 2*a*. Then, the upper and lower wall 15, 16 of the retainer pin 5 are compressed around the core portion 10*a* and plastically deformed so that the upper and lower wall 15, 16 clamp the reinforced portion 12 therebetween with the locking ribs 21 biting into the fastener tape 2, so that the retainer pin 5 is firmly fixed to the fastener tape 2*a*. The plastic deformation of the upper and lower wall 15, 16 is effected throughout the entire length of the retainer pin 5, so that arcuate dents recesses 24 are formed on the outer surfaces of the upper and lower walls 15, 16, and arcuate bulges 24' are formed on the inner surfaces thereof so as to project inward into the cavity 23 in the region of the stopper 22. The retainer pin 5 is attached to the fastener stringer 1*a* with the stopper 22 slightly spaced from the lower edge 11 of the fastener tape 2*a* or the fastener stringer 1 so as not to interfere with the fastener tape 2*a*. The retainer pin 5 has a projecting fin 25 formed longitudinally on its side wall 17 so as to project forward or towards the separable pin 6 therefrom. As better shown in FIG. 3, the projecting fin 25 has a front edge slanted rearward downwardly to provide a slant surface 25'.

Figure 6:
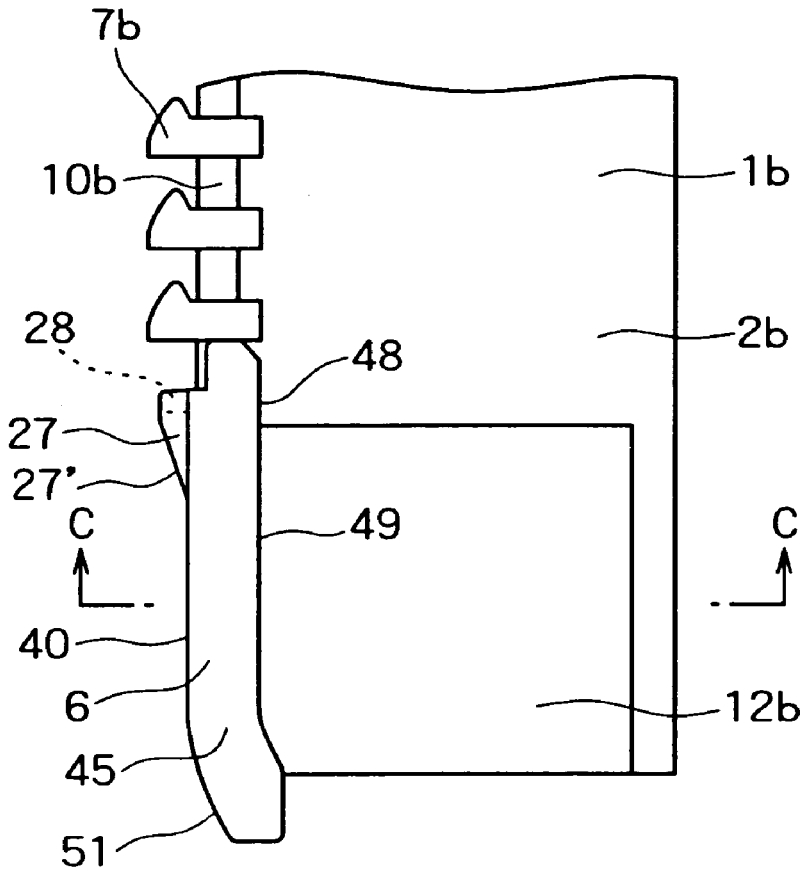
FIG. 6 is a front view of a separable pin (of the reverse-separating device) attached to the other fastener stringer of the slide fastener of FIG. 1.
Figure 7:
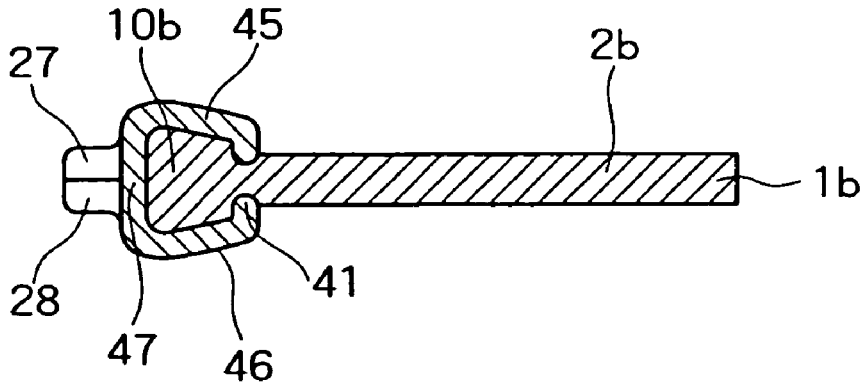
FIG. 7 is a cross-sectional view taken on line C—C of FIG. 6.
Figure 8:
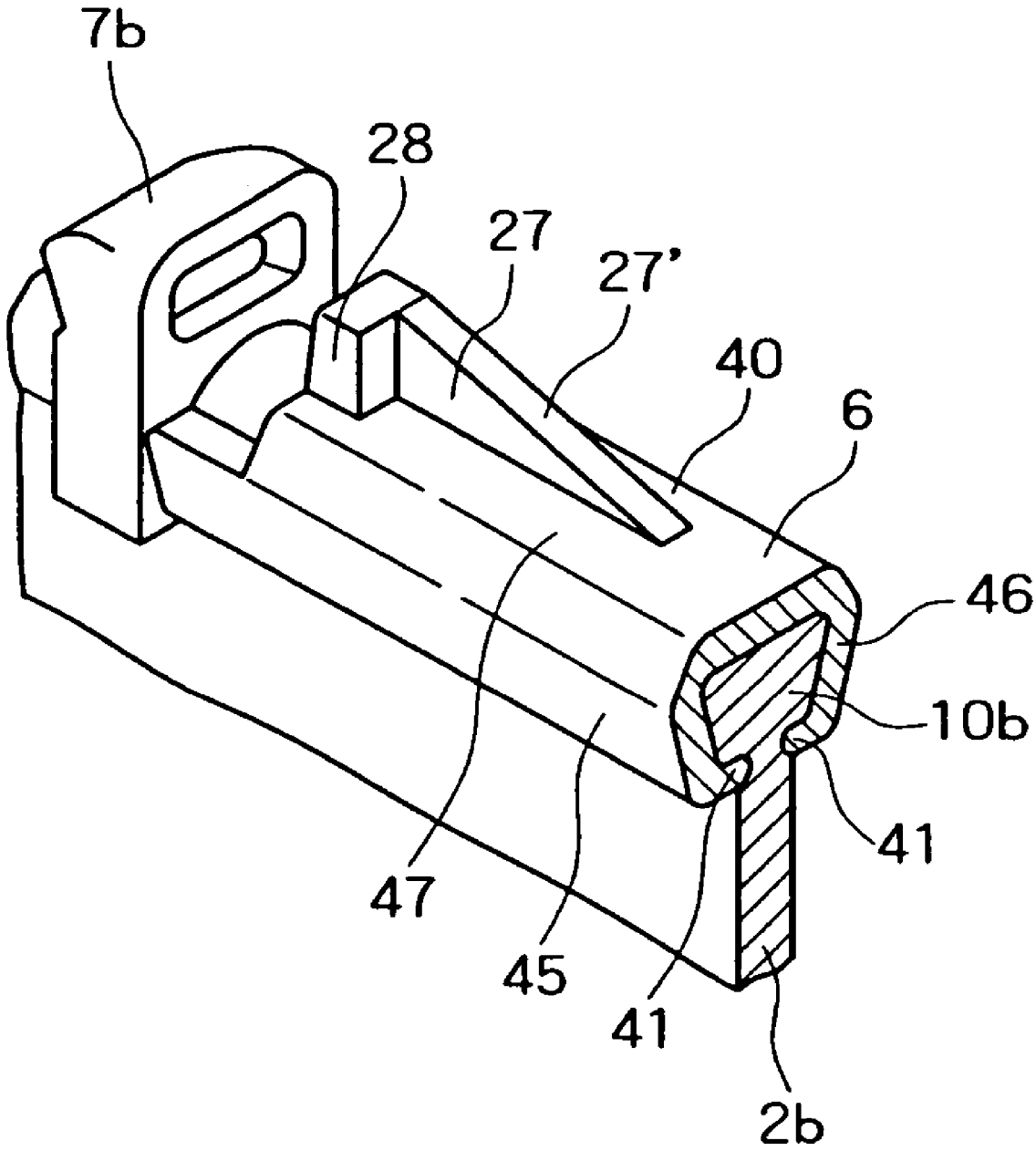
FIG. 8 is a perspective view of the separable pin attached to the other fastener stringer.

Then, as shown in FIGS. 6 through 8, similarly to the retainer pin 5, the separable pin 6 is comprised of an upper wall 45, a lower wall 46, a side wall 47 joining the upper and lower wall 45, 46 at their respective front edges and a slit or opening 48 formed in the side opposed to the side wall 47, to thus provide a substantially U-shaped cross-section. The separable pin 6 is slightly inclined at 51 adjacent to its bottom end to thus facilitate insertion thereof through the upward-separating slider 4 and the reverse-separating slider 3. The separable pin 6 has a projecting fin 27 formed longitudinally on its front edge 40 or its surface opposed to the retainer pin 5 and adapted for overlapping engagement with the projecting fin 25 of the retainer pin 5. As better shown in FIG. 8, a projecting ledge 28 is formed on the upper end or that end of the projecting fin 27 which is closer to the fastener element 7*b* in such a way to project laterally therefrom, to thus provide an inverted L-shaped projection as a whole. With this construction, when the separable pin 6 is inserted through the upward-separating slider 4 into the reverse-separating slider 3, the projecting fin 25 of the retainer pin 5 comes into overlapping relation to the projecting pin 27 of the separable pin 6, and the upper end of the projecting fin 25 of the retainer pin 5 abuts against the projecting ledge 28 of the separable pin 6, thereby preventing the separable pin 6 from further moving down into the reverse-separable pin 3. As a result, the separable pin 6 stops at a proper position relative to the retainer pin 5. The separable pin 6 has a pair of locking ribs 41 formed longitudinally on the rear edges of the upper and lower walls 45, 46 or those edges which are opposed to the front edge, so as to project toward each other or into the slit 48. As better shown in FIG. 6, similarly to the projecting fin 25 of the retainer pin 5, the projecting fin 27 of the separable pin 6 has a front edge slanted rearward downwardly to provide a slant surface 27'. With this construction, as the reverse-separating slider 3 moves upwards from the position indicated in FIG. 11 to uncouple the fastener elements 7*a*, 7*b* from its bottom, both sides of the guidepost 30 of the reverse-separating slider 3 slide along the slant surfaces 25', 27' of the projecting fins 25, 27 to thus separate the retainer pin 5 and the separable pin 6 smoothly.

In order to attach the separable pin 6 to the reinforced portion 12*b* of the fastener tape 2*b*, the reinforced portion 12*b* is first inserted into the slit 48 of the separable pin 6, and then, the upper wall 45 and the lower wall 46 of the separable pin 6 are compressed with the reinforced portion 12*b* interposed therebeween, so that the upper wall 45 and the lower wall 46 of the separable pin 6 firmly claim the reinforced portion 12*b* of the fastener tape 2*b* therebeween, with their locking ribs 41 biting the reinforced portion 12*b*.

As mentioned above, the separable pin 6 has the projecting fin 27 formed on its side wall 47 and adapted for overlapping engagement with the projecting fin 25 of the retainer pin 5. With this construction, once the retainer pin 5 and the separable pin 6 are engaged within the reverse-separating slider 3, they can be maintained in arcurate relative positions even if the reverse-separating device is subjected to severe stresses tending to thrust it up perpendicularly to the fastener plane. Furthermore, the projecting ledge 28 is formed on the upper end of the projecting fin 27 in such a way to project laterally therefrom. With this construction, when the separable pin 6 is inserted through the upward-separating slider 4 into the reverse-separating slider 3 as shown in FIG. 10, the projecting ledge 28 of the separable pin 6 comes into abutting engagement with the upper end of the projecting fin 25 of the retainer pin 5, to thus prevent the separable pin 6 from moving into the sliders 3,4 excessively, so that the retainer pin 5 and the separable pin 6 can be retained in proper relative position.

The reverse-separating slider 3 and the upward-separating slider 4 have their respective element-passing channels 34 formed therein, through which the fastener elements 7*a*, 7*b* pass. Specifically, each slider 3, 4 has a pair of upper and lower wings 33 arranged in parallel to each other and joined by a guidepost 30 to define between the upper and lower wings 33 an element-passing channel 34 through which the fastener elements 7*a*, 7*b* pass. The element-passing channel 34 of each slider 3, 4 extends longitudinally of the slider 3, 4 or from the shoulder side to the bottom side thereof The upper and lower wing 33 have respective pairs of opposed flanges 31 protuberantly formed along their opposed side edges or on the opposite sides of the element-passing channels 34 and adapted for guiding the fastener elements 7*a*, 7*b* when they pass through the element-passing channel 34. The reciprocation of the reverse-separating slider 3 and the upward-separating slider 4 along the rows of fastener elements 7*a*, 7*b* causes the fastener elements 7*a*, 7*b* of the right and left fastener stringers 1*a*, 1*b* pass through the element-passing channels 34 of the reverse-separating slider 3 and the upward-separating slider 4, thus bringing the fastener elements 7*a*, 7*b* into coupling or uncoupling disposition.

Figure 9:
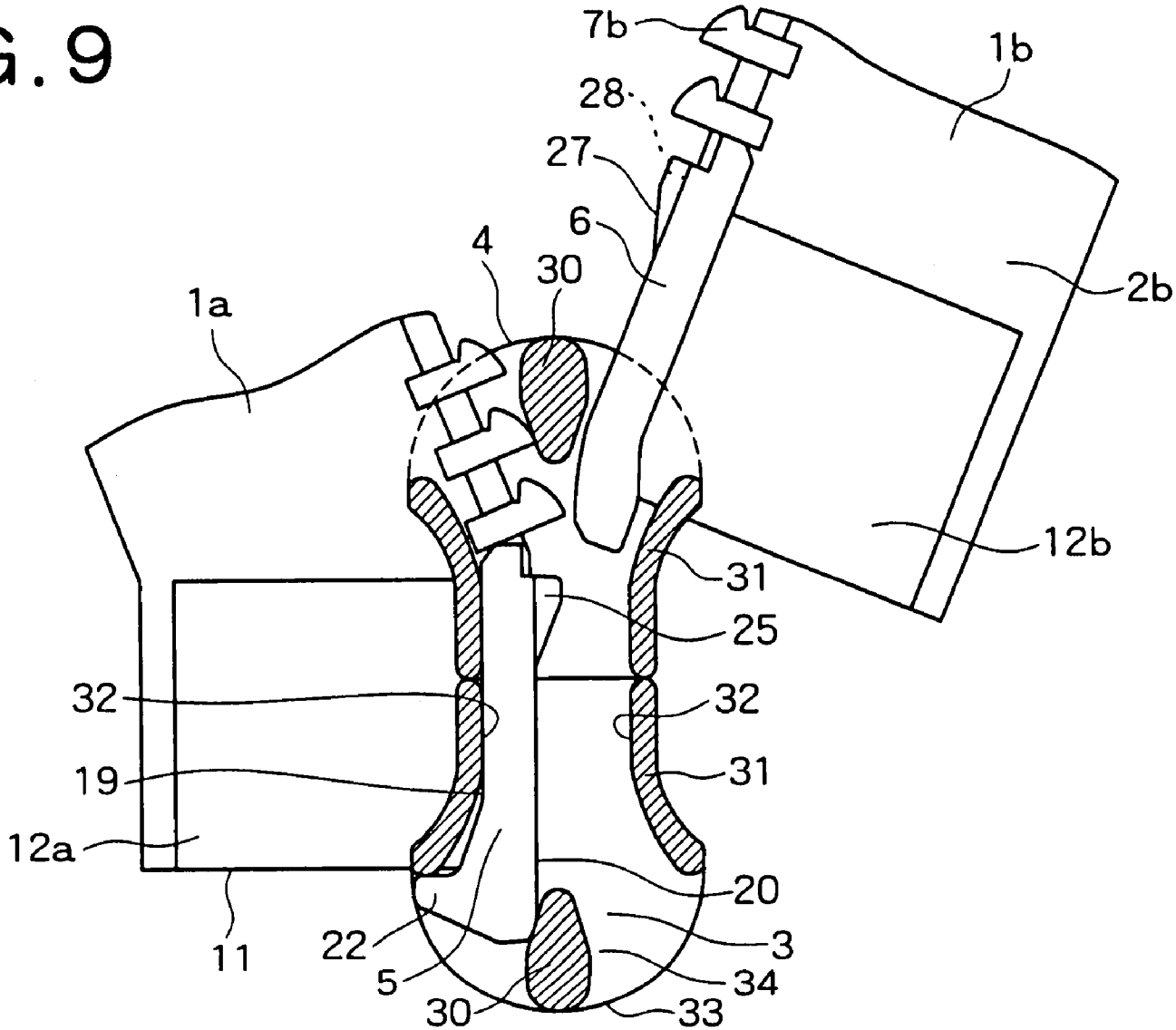
FIG. 9 is a partly cross-sectional fragmentary view of the slide fastener, showing that the separable pin is about to be inserted in to the upward-separating slider.

Turning to the operation of the reverse-separating device; first, the reverse-separating slider 3 slides along the fastener stringer la incorporating the retainer pin 5 downward or towards the retainer pin 5 until the front end of the flange 31 of the reverse-separating slider 3 comes into abutting engagement with the stopper 22 of the retainer pin 5. Then, the upward-separating slider 4 slides downwards or towards the retainer pin 5 until the upward-separating slider 4 comes into abutting engagement with the bottom end of the reverse-separating slider 3. Then, as shown in FIG. 9, the separable pin 6 attached to the other stringer 1*b* is inserted through the upward-separating slider 4. At this moment, the front edge 20 of the lower part of the retainer pin 5 abuts against the guidepost 30 of the reverse-separating slider 3, while the rear edge 19 of the upper part of the retainer pin 5 abuts against the inner surface 32 of the flanges 31 of the reverse-separating slider 3. This means that, when the retainer pin 5 is disposed in the element-passing channel 34 of the reverse-separating slider 3, the retainer pin 5 abuts against three parts of the reverse-separating slider 3, that is, the front end of the flanges 31, the guidepost 30 and the inner surface 32 of the flanges 31, so that the retainer pin 5 can maintain its predetermined posture, and the stopper 22 of the retainer pin 5 keeps in reliable engagement with the lower end of the flanges 31.

Figure 10:
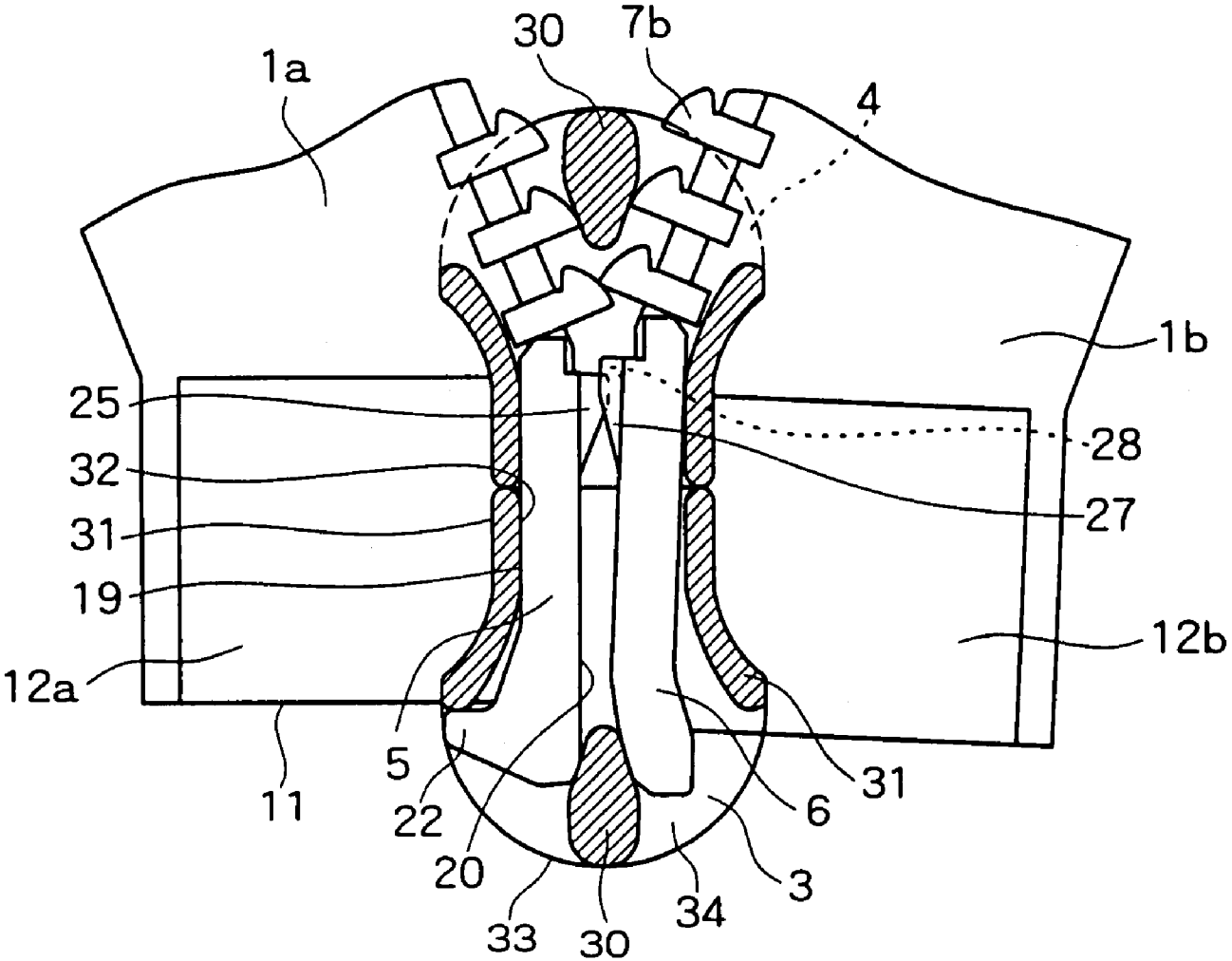
FIG. 10 is similar to FIG. 9, but showing that the separable pin is fully inserted through the upward-separating slider into the reverse-separating slider.
Figure 11:
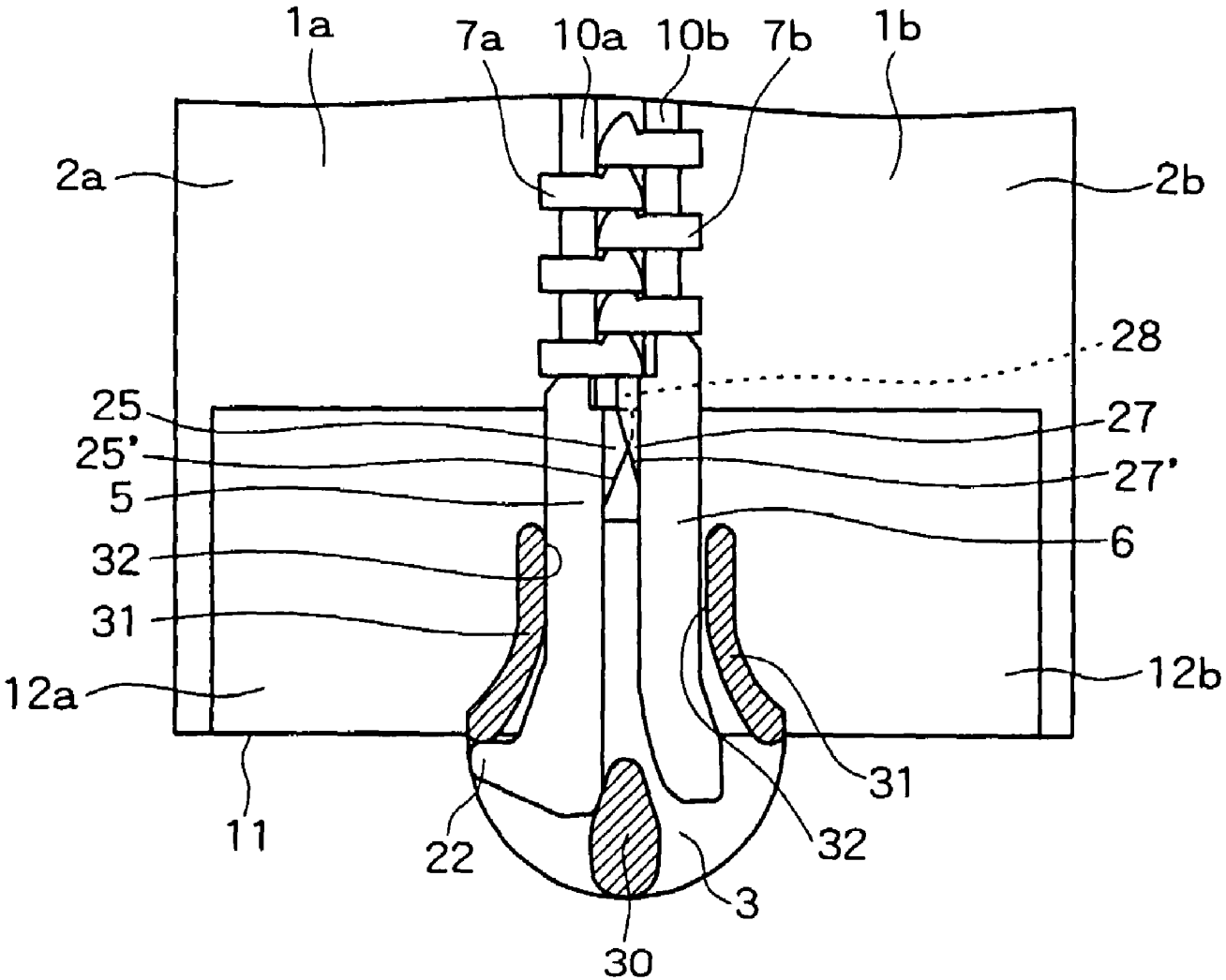
FIG. 11 is similar to FIG. 10, but showing that the upward-separating slider moves upward so that the fastener elements are coupled.
Figure 12:
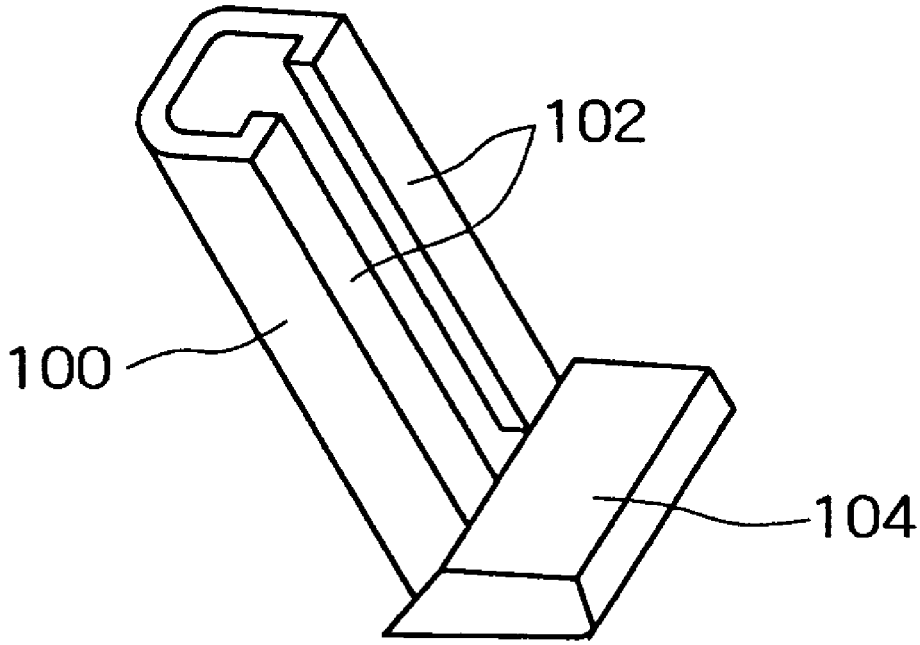
FIG. 12 PRIOR ART
FIG. 12 is a perspective view of a retainer pin of a conventional reverse-separating device.

As shown in FIG. 10, the separable pin 6 continues to be inserted through the upward-separating slider 4 and then into the reverse-separating slider 3 until the projecting ledge 28 of the projecting fin 27 of the separable pin 6 abuts against the upper end of the projecting fin 25 of the retainer pin 5, whereupon the retainer pin 5 and the separable pin 6 have been placed in suitable relative position. Thereafter, moving the upward-separating slider 4 upward apart from the reverse-separating slider 3 causes the fastener elements 7*a*, 7*b* of the left and right fastener stringers 1*a*, 1*b* into coupling engagement with each other, thus closing the fastener stringers 1*a*, 1*b*. When one desires the closed right and left fastener stringers 1*a*, 1*b* to be opened only at their lower part, he only has to move the reverse-separating slider 3 upwardly or apart from the retainer pin 5, so that the fastener elements 7*a*, 7*b* of the left and right fastener stringers 1*a*, 1*b* are uncoupled and the fastener stingers 1*a*, 1*b* are opened at their lower part to the extend that he desires.

In order to fully open the left and right fastener stringers 1*a*, 1*b*, the reverse-separating slider 3 is moved down towards the retainer pin 5 into abutting engagement with the stopper 22 of the retainer pin 5, and then the upward-separating slider 4 is moved down towards the reverse-separating slider 3 into abutting engagement with the reverse-separating slider 3, so that the left and right fastener stringers 1*a*, 1*b* are separated except for their bottoms. Then, the separable pin 6 attached to the other fastener stringer 1*b* is pulled apart from the reverse-separating slider 3 and the upward-separating slider 4, so that the left and right fastener stringers 1*a*, 1*b* are fully opened. In the slide fastener incorporating the reverse-separating device according to the present invention, the fastener elements 7*a*, 7*b*, the retainer pin 5, the separable pin 6, the upward-separating slider 4 and the reverse-separating slider 3 are all made of metal. The slide fastener is attached to the front side of a jumper, overcoat or other garment where an opening is formed in its front.

Conclusions, Ramifications, and Scope:

The retainer pin and separable pin of the reverse-separating device according to this invention are simple in construction, and so they each can be produced in a single step through die-casting process. When each of the retainer pin and the separable pin is clamped to the respective fastener tape, the upper and lower walls of the retainer pin undergoes plastic deformation throughout the entire length Since the stopper of the retainer pin is a loop-like with a cavity formed therein, the stopper will not prevent its upper and lower walls from being plastically deformed uniformly throughout their entire length. Furthermore, while a multiplicity of retainer pins are subjected to a grinding process in a barrel grinding machine or a feeding process in an automatic parts feeding machine, etc., the retainer pins will never be tangled with each other, so that the retainer pins can undergo grinding and feeding operations, etc. smoothly.

Furthermore, the retainer pin has a pair of recesses formed on the outer surfaces of the upper and lower walls in the region of the stopper. With this construction, when the retainer pin is clamped to the lower end of the fastener tape, it can undergoes plastic deformation through the entire length, so that the retainer pin can be attached to the fastener tape reliably and sightly.

The retainer pin is attached to the fastener stringer with its stopper slightly spaced from the lower edge of the fastener tape or the fastener stringer. Therefore, the impact that the stopper suffers when the stopper stops the reverse-separating slider will not influence the end of the fastener tape, so that the reverse-separating device is durable. The retainer pin can be used reliably for a long period of time.

The retainer pin and the separable pin have their respective projecting fins formed longitudinally on their respective side walls so as to project forward therefrom. When the retainer pin and the separable pin are disposed in opposed relation, the projecting fins of both pins comes into overlapping engagement with each other. With this construction, even if the reverse-separating device is subjected to heavy stresses tending to thrust up perpendicularly of the fastener chain, the proper relative position between the retainer pin and the separable pin will not be disrupted, so that the coupled fastener element rows will never be uncoupled from their bottom ends. Furthermore, the separable pin has a projecting ledge formed on the upper end of the projecting fin so as to extend laterally therefrom and the projecting ledge is adapted to abut against the projecting fin of the retainer pin and to thus prevent the separable pin from further moving into the reverse-separating slider. Therefore, the separable pin is prevented from being inserted more than needed, so that the wearer can place the retainer pin and the separable pin in suitable relative position reliably and easily.

When the stopper of the retainer pin comes into abutting engagement with the flange of the reverse-separating slider, the lower end of the front edge of the retainer pin abuts against the guidepost of the reverse-separating slider, while the rear edge of the retainer pin abuts against the inner surface of the flanges of the reverse-separating slider, so that the retainer pin can be firmly retained within the reverse-separating slider. Therefore, the retainer pin is supported within the reverse-separating slider at their three points and so can maintain its predetermined posture therein, and the stopper and the flange of the reverse-separating slider can keep engaged with each other reliably.

While the above descriptions contain many specificities, these shall not be construed as limitations on the scope of the invention, but rather as exemplificatons of embodiments thereof. Many other variations are possible. Accordingly, the scope of the invention should be determined not by the embodiments illustrated, but by the appended claims and the legal equivalents.

What is claimed is:

1. A reverse-separating device for a slide fastener comprised of a pair of fastener stringers including a pair of fastener tapes and two rows of fastener elements mounted along respective opposed longitudinal edges thereof; the reverse-separating device comprising a retainer pin made of metal and attached to a lower end of one fastener stringer, a separable pin made of metal and attached to the other stringer and a reverse-separating slider mounted reciprocally on the rows of the fastener elements and having a pair of flanges formed on its respective opposed sides; each of the retainer pin and the separable pin comprising a pair of upper and lower walls, a side wall connecting the upper and lower walls along a front edge thereof and a slit formed longitudinally along a rear edge to provide a U-shaped cross-section; and at a lower end of the slit, the upper wall and the lower wall of the retainer pin projected rearward beyond the slit and being connected by a bridge portion to provide a loop-shaped stopper with a cavity formed therein, the loop-shaped stopper being adapted to abut against the flange of the reverse-separating slider and to stop downward movement thereof.

2. A reverse-separating device according to claim 1, wherein the retainer pin has a pair of recesses formed on outer surfaces of the upper and lower walls respectively, in the region of the stopper.

3. A reverse-separating device according to claim 1, wherein the stopper is spaced from a lower edge of the fastener tape.

4. A reverse-separating device according to claim 1, wherein the retainer pin and the separable pin have projecting fins formed longitudinally on their respective side walls so as to project forward therefrom; when the retainer pin and the separable pin are disposed in opposed relation, the projecting fins coming into overlapping engagement with each other; the separable pin having a projecting ledge formed on an upper end of the projecting fin so as to project laterally therefrom; and the projecting ledge being adapted to abut against the upper end of the projecting fin of the retainer pin, and prevent the separable pin from further moving into the reverse-separating slider.

5. A reverse-separating device according to claim 1, wherein, when the stopper comes into engagement with the reverse-separating slider, the front edge of the retainer pin abuts against a guidepost of the reverse-separating slider, while the rear edge of the retainer pin abuts against an inner surface of the flanges of the reverse-separating slider, so that the retainer pin can be firmly maintained within the reverse-separating slider.

6. A reverse-separating device according to claim 1, wherein the retainer pin and the separable pin have projecting fins formed longitudinally on their respective side walls so as to project forward therefrom; when the retainer pin and the separable pin are disposed in opposed relation, the projecting fins coming into overlapping engagement with each other; the projecting fins of the retainer pin and the separable pin having their respective front edges slanted rearward downwardly to provide slant surfaces.

* * * * *